US009543100B2

(12) United States Patent
Kellner

(10) Patent No.: US 9,543,100 B2
(45) Date of Patent: Jan. 10, 2017

(54) RELAY HAVING ROWS OF CONTACTS THAT ARE SEPARATED BY AN ISOLATION CONFIGURATION

(71) Applicant: HENGSTLER GmbH, Aldingen (DE)

(72) Inventor: Jozef Kellner, Vlkovce (SK)

(73) Assignee: HENGSTLER GMBH, Aldingen (DE)

( * ) Notice: Subject to any disclaimer, the term of this patent is extended or adjusted under 35 U.S.C. 154(b) by 0 days.

(21) Appl. No.: 14/086,185

(22) Filed: Nov. 21, 2013

(65) Prior Publication Data

US 2014/0139303 A1 May 22, 2014

(30) Foreign Application Priority Data

Nov. 21, 2012 (DE) ..... 10 2012 022 792

(51) Int. Cl.

| | |
|---|---|
| ***H01H 50/54*** | (2006.01) |
| ***H01H 50/04*** | (2006.01) |
| ***H01H 50/64*** | (2006.01) |
| *H01H 50/02* | (2006.01) |

(52) U.S. Cl.

CPC ..... *H01H 50/54* (2013.01); *H01H 50/043* (2013.01); *H01H 50/642* (2013.01); *H01H 50/548* (2013.01); *H01H 2050/028* (2013.01)

(58) Field of Classification Search

CPC H01H 50/54; H01H 50/642; H01H 2050/028; H01H 50/548; H01H 50/043

USPC ..... 335/2, 78, 128, 129, 131, 133, 202

See application file for complete search history.

(56) References Cited

U.S. PATENT DOCUMENTS

| | | | | |
|---|---|---|---|---|
| 4,405,911 | A | 9/1983 | Hasegawa et al. | |
| 4,665,375 | A * | 5/1987 | Weiser | H01H 50/548 335/128 |
| 5,696,475 | A | 12/1997 | Yoshitani et al. | |
| 6,034,582 | A * | 3/2000 | Fausch | 335/78 |
| 7,633,363 | B2 * | 12/2009 | Fausch | H01H 50/026 335/124 |
| 8,093,973 | B2 * | 1/2012 | Takaya et al. | 335/133 |

(Continued)

FOREIGN PATENT DOCUMENTS

| | | |
|---|---|---|
| DE | 3437544 A1 | 4/1986 |
| DE | 3929877 A1 | 3/1991 |

(Continued)

OTHER PUBLICATIONS

English language translation of the extended European Search Report for Appln. No. 13 004 957.0 issued Feb. 28, 2014.

(Continued)

*Primary Examiner* — Bernard Rojas

(74) *Attorney, Agent, or Firm* — Browdy and Neimark, P.L.L.C.

(57) ABSTRACT

A relay is provided having a contact set that is disposed in a cover and in a spring bracket, wherein the rows of contacts are isolated by an isolation configuration comprising at least one fixed partition provided on the cover and at least one oppositely oriented fixed partition provided on the spring bracket, and additionally at least one movable actuator is disposed in the space between the cover and the spring bracket, wherein the isolation configuration comprises two mutually parallel and mutually spaced-apart partitions provided on the cover and one partition provided on the spring bracket engaging between the partitions provided on the cover.

7 Claims, 6 Drawing Sheets

(56) References Cited

U.S. PATENT DOCUMENTS

| | | | | |
|---|---|---|---|---|
| 2005/0270129 | A1* | 12/2005 | Menard | H01H 61/0107 335/83 |
| 2012/0154077 | A1 | 6/2012 | Mikl | |

FOREIGN PATENT DOCUMENTS

| | | | |
|---|---|---|---|
| DE | 69612771 | T2 | 4/2002 |
| EP | 0192928 | A1 | 9/1986 |
| EP | 0954001 | A1 | 11/1999 |
| JP | S63137431 | U | 9/1988 |
| JP | 2010/198958 | A | 9/2010 |
| WO | 2010/098081 | A | 9/2010 |

OTHER PUBLICATIONS

Office action from the European Patent Office for Application No. 13 004 957.0-1808, dated Dec. 4, 2015 including an English language translation.

* cited by examiner

RELAY HAVING ROWS OF CONTACTS THAT ARE SEPARATED BY AN ISOLATION CONFIGURATION

FIELD

The invention relates to an isolation configuration for the contact set of a relay having a contact set that is disposed in a cover and in a spring bracket, the rows of contacts being separated by an isolation configuration.

BACKGROUND

In relays of this type, the rows of contacts of the contact set are separated from each other either only by air paths or by movable or fixed ribs. Usually, an actuator is disposed between the ribs. The actuator is designed T-shaped or U-shaped and which is supported on the armature and on the movable parts.

EP 0 634 767 B1 discloses a relay having a contact set. In FIG. 2, the relay is shown with a cover and a spring bracket.

Two fixed partitions are disposed in each case on the cover and two fixed partitions are also disposed on the spring bracket situated thereunder. Between these partitions, a movable horizontal actuator having a vertical flange is disposed. The vertical flange is disposed between the partitions, partially covering the partitions of the cover and of the spring bracket. This achieves an isolation between the rows of contacts.

According to the prior art, it is therefore known that both the cover and the spring bracket have fixed vertical partitions, a movable actuator having at least one vertical flange being disposed therebetween. The desired isolation distance is therefore achieved by means of the fixed partitions and the movable vertical flange of the actuator.

With the subject matter of EP 0 192 928 A1, an electromagnetic relay according to the preamble of independent claims 1 to 3 has become known in which the partitions 25 provided on the cover extend over the partitions 23 provided on the spring bracket. The actuator, however, is disposed outside this space between the partitions provided on the cover and on the spring bracket, on the side wall of the cover. This results in a very space-consuming design, as the actuators are disposed on the outside of the mutually overlapping partitions, thus resulting in a very wide housing design. The drive of the actuator is disposed between the partitions in the center of the interior of the spring bracket, which is associated with the drawback that this makes the housing very wide. The contacts are disposed on the actuator actuating the contact springs. The actuator therefore is also the contact carrier. The actuator therefore cannot provide any additional isolating effect between the active and the passive contact springs. If unwanted contact erosion occurs in the region of the contact sets, unwanted malfunctions can occur, such as contact closure within a contact.

EP 0 954 001 A1, which relates to a similar electromagnetic relay, shows only a very short partition 71 provided on the cover that projects into the interior of the relay and engages into a V-shaped upwardly open groove 49 of two short V-shaped partitions 63 disposed on the top side of the spring bracket. This is associated with the drawback that no protection of the contacts is provided at all by the partition provided on the cover and the partitions provided on the spring bracket.

From DE 34 37 544 C2, a low-voltage relay has become known in which only a middle divider 26 is disposed between two contact chambers that engages with the lower free end thereof into a corresponding V-shaped, upwardly open groove between two legs on a spring bracket.

Each contact chamber houses one contact. The actuator is designed as a galvanically conductive element, and the contacts in the two contact chambers therefore are galvanically connected to one another. The middle divider 26 does in fact also have the function of preventing contact erosion from entering from one side into the other, but since the contacts of one chamber are galvanically connected to the contacts of the other chamber, isolation between the contacts on one side of the chamber and the contacts on the other side of the chamber is of no significance, as these are contacts that are galvanically connected to each other.

FIG. 1 shows an isolation configuration for a relay according to the prior art. The isolation configuration 1 substantially comprises a cover 2 and an opposed spring bracket 3.

On the cover 2, a vertically downwardly extending first partition 5 is disposed. The opposed spring bracket has a partition 6 extending vertically upward toward the cover. A movable actuator 4 is disposed between the two components that are the cover 2 and the spring bracket 3 and the associated partitions 5 and 6. The actuator 4 has two vertical flanges 7 that surround the two partitions 5 and 6. In the present embodiment, the isolation of the contact set is achieved via the two partitions 5 and 6 and the two flanges 7 of the movable actuator 4.

FIG. 2 shows a further embodiment according to the prior art. Here, the flanges 7 of the actuator are movably disposed between the vertical partitions 5 and 5' of the cover 2 and the partitions 6 and 6' of the spring bracket 3. This is the reversal of the embodiment according to FIG. 1, because there the flanges 7 and 7' enclose the individual partitions 5 and 6.

The at least one actuator 4 is a part of the isolation configuration and acts as isolating separation between the two contact rows 11, 12. It is moved in the direction perpendicular to the drawing plane of the figures in the directions of arrow 10. In the prior art, the actuator 4 is integrated in a disadvantageous manner by the flange 7 thereof according to FIG. 2 or the flanges 7, 7' according to FIG. 1 into the isolation configuration and deteriorates the leakage-current properties and isolation properties of the relay, as the insulating overlap of the stationary opposing partitions provided on the cover and on the spring bracket is deteriorated by the actuator 4 movable therebetween.

SUMMARY

It is an object of the invention to solve the above-mentioned problems with the prior art configuration. In furtherance of this and other objects, the invention, proceeds from a relay having on the spring bracket a plurality of contacts galvanically isolated from each other that carry a variety of different potentials and that are optionally designed as normally closed and/or normally open contacts. It is therefore important to always prevent, in the case of the contacts carrying different potentials that are designed as normally closed or normally open contacts, that the potential of one contact can be carried over to the potential of the other contact, for example through a bridging of the isolation (conductivity bridge). Such a conductivity bridge can be caused, for example, by contact erosion occurring between the contacts that is unintentionally and unwantedly carried over toward the other contact.

This is where the invention comes in, which prevents such a carry-over of contact erosion in relay contacts that carry different potentials.

It is the aim of the present invention to attain a configuration on the smallest possible installation space that meets in particular the requirement of providing isolation on the smallest possible installation space, between the rows of contacts of the contact set of a relay.

In order to meet this aim, the invention is characterized by the disclosed and claimed exemplary embodiments.

In particular, according to one exemplary embodiment, a relay is provided having a contact set that is disposed in a cover and in a spring bracket, wherein the rows of contacts are separated by an isolation configuration. The relay comprises at least one fixed partition provided on the cover, at least one oppositely oriented fixed partition provided on the spring bracket, and at least one movable actuator disposed in the space between the cover and the spring bracket. The isolation configuration comprises the at least one fixed partition comprising two mutually parallel and mutually spaced-apart partitions provided on the cover and the at least one oppositely oriented fixed partition comprising one oppositely oriented partition provided on the spring bracket that engages between the two parallel and mutually spaced-apart partitions provided on the cover. The relay further comprises flanges having a length parallel to and flush with a plane in which the two mutually parallel and mutually spaced-apart fixed partitions and the one oppositely oriented partition lie. The flanges are integrally formed on the actuator.

According to another exemplary embodiment, a relay is provided having a contact set that is disposed in a cover and in a spring bracket, wherein the rows of contacts are separated by an isolation configuration. The relay comprises at least one fixed partition provided on the cover, at least one oppositely oriented fixed partition provided on the spring bracket, and at least one movable actuator disposed in the space between the cover and the spring bracket. The isolation configuration comprises the at least one oppositely oriented fixed partition comprising two mutually parallel and mutually spaced-apart partitions provided on the spring bracket, and the at least one partition provided on the cover that engages between the two mutually parallel and mutually spaced-apart partitions provided on the spring bracket. The relay further comprises flanges having a length parallel to and flush with a plane in which the two mutually parallel and mutually spaced-apart fixed partitions and the at least one partition lie. The flanges are integrally formed on the actuator.

According to another exemplary embodiment a relay is provided having a contact set that is disposed in a cover and in a spring bracket, wherein the rows of contacts are separated by an isolation configuration. The relay comprises at least one fixed partition provided on the cover, at least one oppositely oriented fixed partition provided on the spring bracket, and at least one movable actuator is disposed in the space between the cover and the spring bracket. The isolation configuration comprises the at least one fixed partition comprising two mutually parallel and mutually spaced-apart partitions provided on the cover and the at least one oppositely oriented fixed partition comprising one partition provided on the spring bracket that engages between the partitions provided on the cover. The relay further comprises flanges having a length parallel to a plane in which the two mutually parallel and mutually spaced-apart partitions lie. The flanges are integrally formed on the actuator.

It is an essential feature of the invention that the shape of the actuator with flanges provided thereon now ensures that the isolation between the contacts is improved. Therefore, if any contact erosion occurs in the region of the actuator and of the contacts actuated by the actuator, the flanges ensure that the mutually overlapping covers and partitions provided on the spring bracket are covered from the side, such that any contact erosion on the contact sets cannot enter into the isolation space that is created by the mutually overlapping covers and partitions provided on the spring bracket.

As a result, this space that is created by the mutually engaging partitions provided on the cover and on the spring bracket is not encumbered by contact erosion that could result in a reduction in the isolation distance.

The isolation distance that is created by the covers and by the partitions provided on the spring bracket that mutually engages in a labyrinth-like manner is therefore not reduced or even bridged by contact erosion entering there.

This is an essential advantage of the invention, because a large isolation distance can now be created in the smallest possible space, because flanges disposed on the actuator prevent from the beginning that any contact erosion caused by the contact sets on the actuator can enter into the isolation space between the mutually engaging covers and partitions provided on the spring bracket.

The invention describes in several independent claims how this isolation configuration having mutually engaging covers and partitions provided on the spring bracket is designed. This is substantially a labyrinth-like configuration, in such a way that one or two partitions are disposed on the cover in each case and the one or two partitions provided on the cover always engage into an opposite configuration made up of one or two partitions provided on the spring bracket, wherein the partitions overlap each other along a very long distance and cover virtually the entire configuration space between the underside of the cover and the top side of the spring bracket.

The flanges of the actuator are then disposed in extension of the straight line of either the partitions provided on the cover or the partitions provided on the spring bracket, so that the best possible lateral covering of the entire configuration space between the underside of the cover and the top side of the spring bracket is achieved.

In lieu of an aligned arrangement of the flanges of the actuator relative to the plane of the partitions, it can be possible in another embodiment for the flanges of the actuator to be disposed not in one plane but at a lateral distance to the partitions provided on the cover or on the spring bracket, but to nonetheless optimally cover same from the side.

All of the embodiments described therefore achieve the best possible lateral covering of the important isolation distance between the mutually engaging covers and partitions provided on the spring bracket, by means of the inventive flanges of the actuator that prevent contacts disposed on the actuator and any contact erosion occurring there from entering into the isolation space.

It is an essential feature that, in order to effect the isolation between the rows of contacts of the contact set, the cover has at least one fixed partition and the spring bracket likewise has at least one fixed partition. The movable actuator is disposed in this arrangement outside the isolation configuration.

The isolation configuration accordingly comprises in a first embodiment two mutually parallel and mutually spaced apart partitions provided on the cover and one partition provided on the spring bracket engaging between the partitions provided on the cover and therefore providing a favorable isolation, or, in a second embodiment, the isolation configuration comprises two mutually parallel and mutually spaced-apart partitions provided on the spring bracket and one partition provided on the cover engaging between the two partitions provided on the spring bracket.

It is therefore essential that the actuator is not a part of this isolation configuration, but is disposed outside the isolation configuration.

Thus, an advantageous embodiment of the present invention has on the cover two vertical, spaced-apart, fixed partitions and on the spring bracket one vertical fixed partition. The single partition of the spring bracket is disposed here between the vertical partitions of the cover. The vertical lengths of the partitions are designed such that they mutually laterally cover each other.

The vertical partition of the spring bracket therefore dips down between the two partitions of the cover. This creates long isolation distances between the mutually engaging partitions of the cover and of the spring bracket, without the actuator participating in the isolation. It is therefore no longer essential that the actuator, optionally with flanges integrally formed thereon, must enlarge the isolation distance, as this is the case in the prior art.

It is now novel in the invention that the actuator is no longer guided between the two partitions of the cover or of the spring bracket. This creates the significant advantage that, owing to the special arrangement of the fixed partitions of the cover and of the spring bracket, a good isolation that is independent of the actuator is achieved on the smallest possible installation space.

The arrangement can also be mirrored, of course, so that the two partitions of the cover can be disposed on the spring bracket and the cover has the single partition that is disposed between the two partitions.

It is important in the invention that the at least one movable actuator does not extend between the partitions, but is split by the single partition that is disposed either on the cover or on the spring bracket.

The immersion depth of the individual opposed partitions must be designed such that the requirement is always well met. Therefore, the height of the partitions can vary, of course.

The movable actuator does not form any part of the configuration of the isolation. Thus, the two partitions and the single partition projecting therebetween from below create an isolation, the at least one actuator for a row of contacts being movably disposed outside this isolation.

It is important that no moving parts form any part of the configuration of the isolation, as this is known in the prior art.

The subject matter of the present invention derives not only from the subject matter of the individual claims but also from the individual claims taken in combination with each other.

All of the details and features disclosed in the documents, including in the Abstract, and in particular the physical form illustrated in the drawings, are claimed as essential to the invention in so far as they are novel, whether separately or in combination, with respect to the prior art.

BRIEF DESCRIPTION OF THE DRAWINGS

The invention will now be described in detail with reference to a drawing illustrating just one way of carrying out the invention. Further features essential to the invention and advantages of the invention will be apparent from the drawings and from their description.

In the drawings.

DETAILED DESCRIPTION

Figure 1:
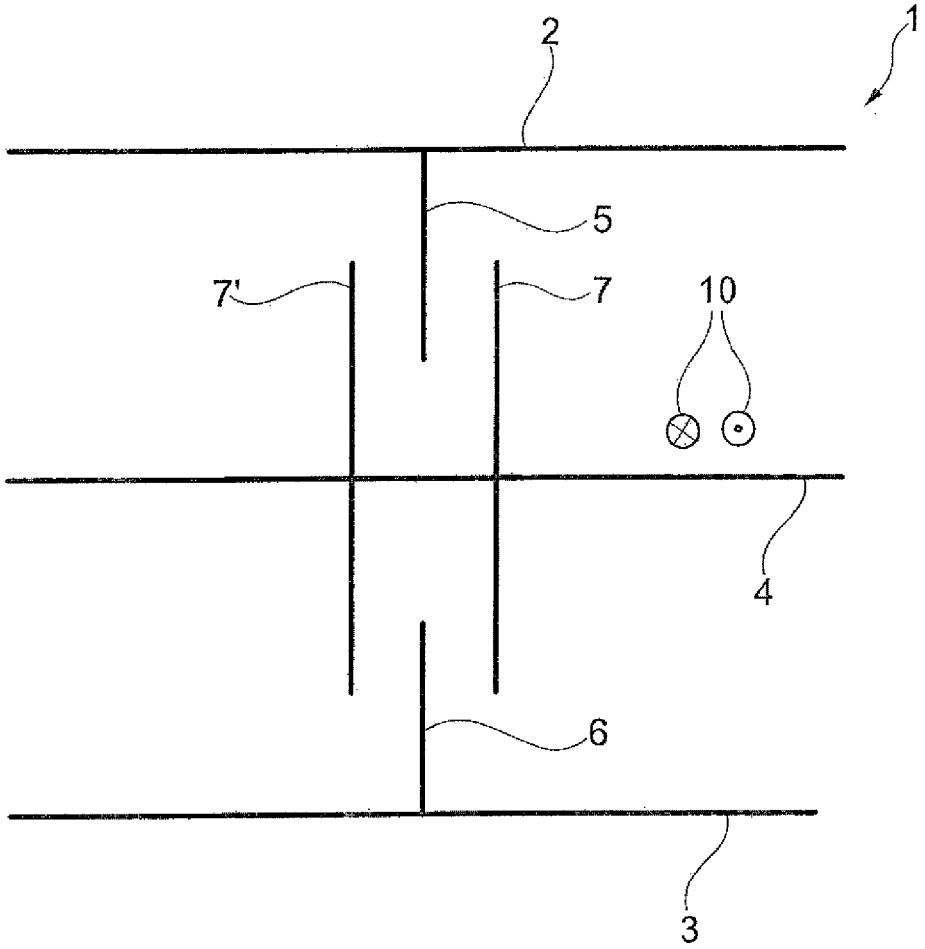
Fig. 1 (Prior Art)
FIG. 1 is a schematic illustration of an isolation configuration according to the prior art, with two partitions.
Figure 2:
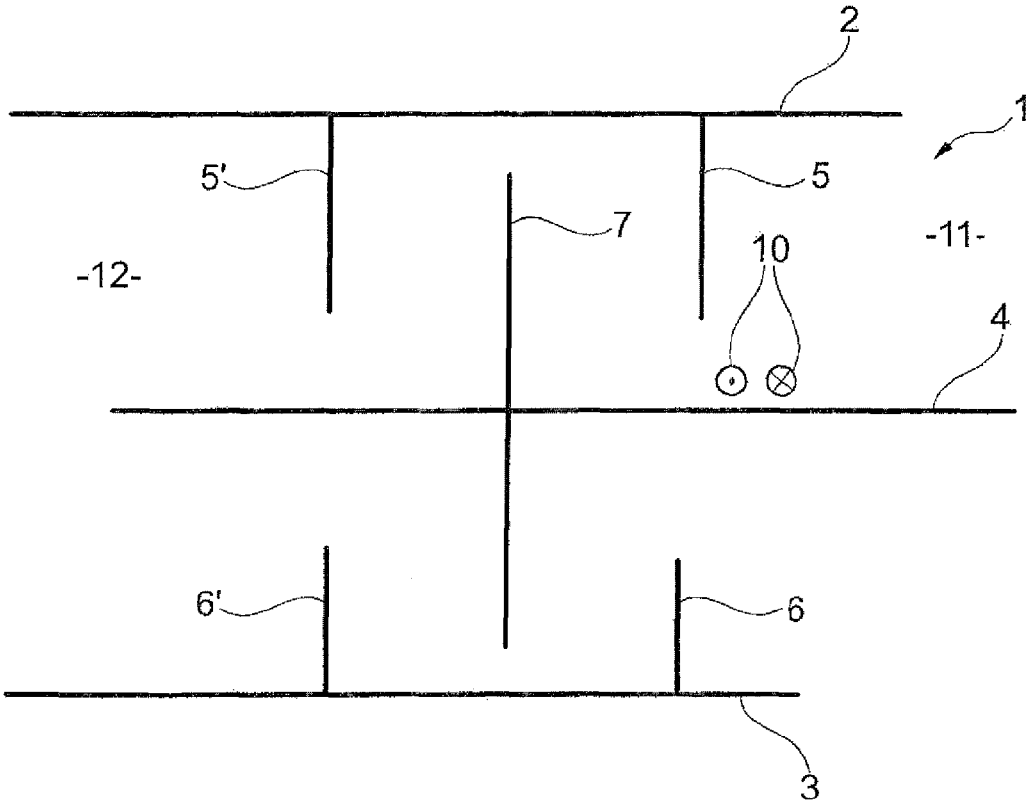
Fig. 2 Prior Art
FIG. 2 is a schematic illustration of an isolation configuration according to the prior art, with four vertical partitions.

The drawings according to the invention in FIGS. 3 to 6 show possible first embodiments of the arrangement of partitions provided on the cover and on the spring bracket.

However, it is not shown in the drawings in which the partition arrangement shown here is exactly reversed. That is to say, if one turns the drawings of FIGS. 3 to 6 upside down and assumes that in the upside-down drawings the cover 2 is always located at the top and the spring bracket 3 at the bottom, then this is a further embodiment for all of the drawings according to FIGS. 3 to 6, which is likewise intended to be encompassed by the claims.

As a result this means that the embodiment of the covers and spring brackets as illustrated in FIGS. 3 to 6 can be reversed, so that reference numerals 2 and 3 are then switched.

Figure 3:
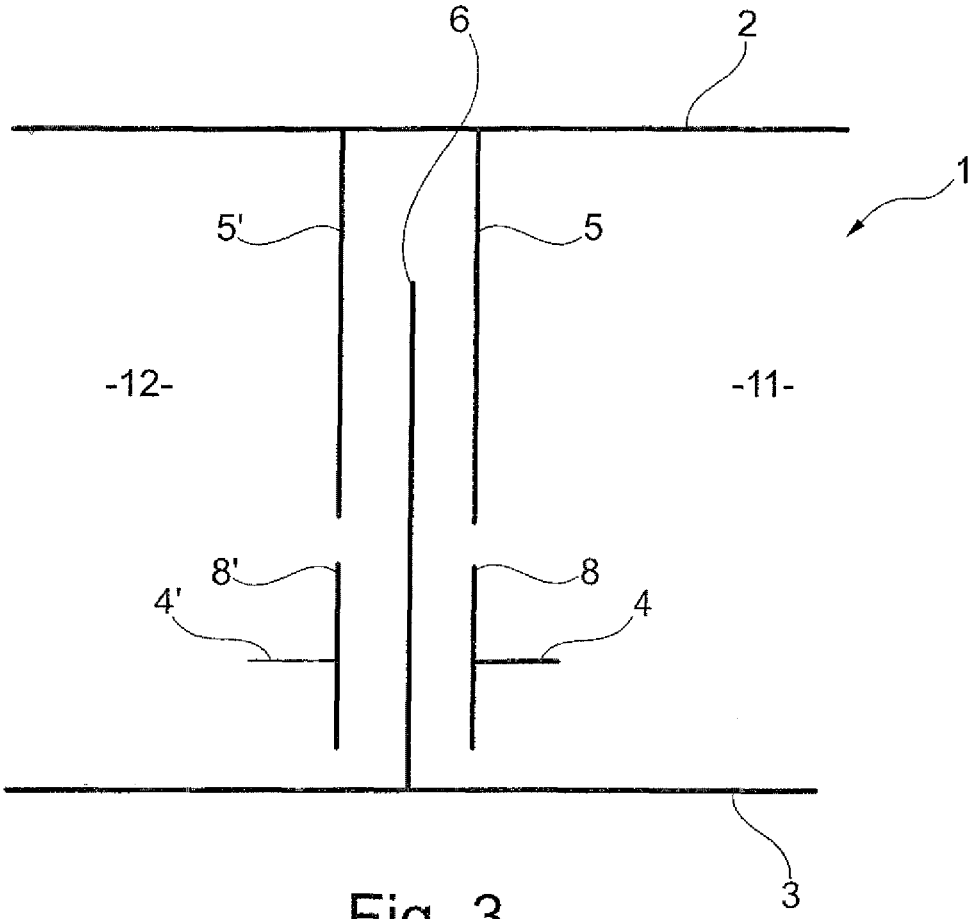
FIG. 3 is a schematic illustration of an isolation configuration according to the invention, according to a first embodiment.
Figure 4:
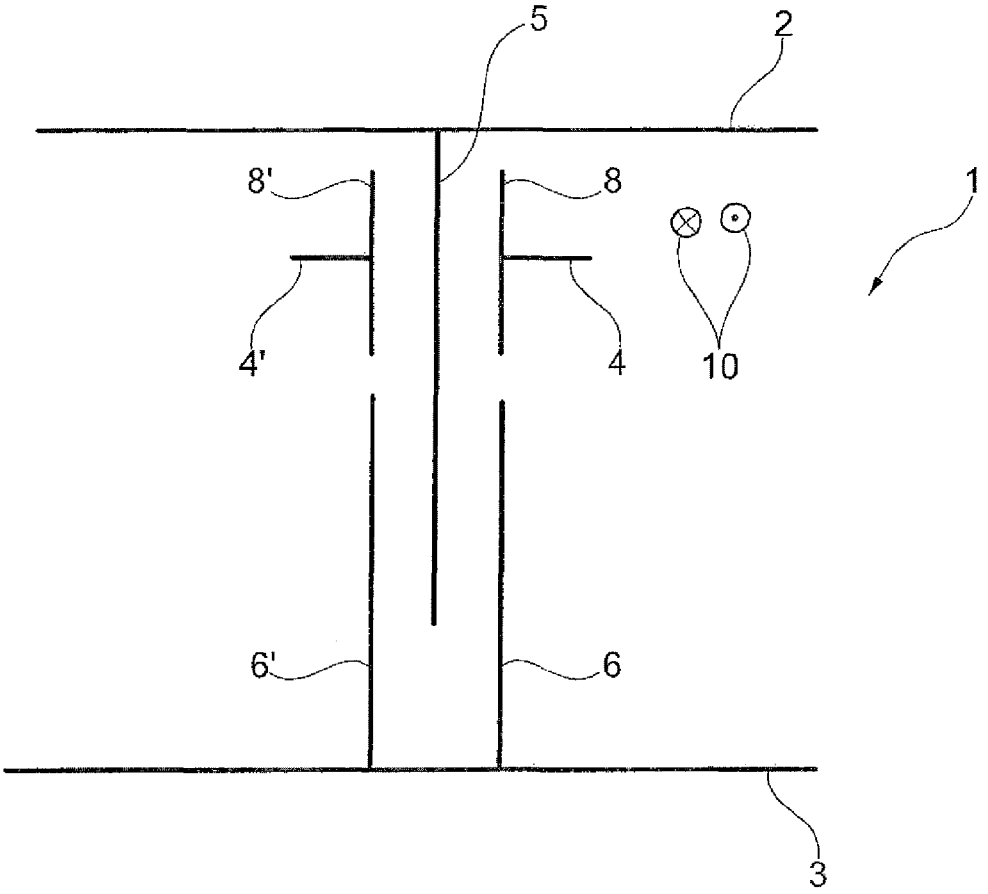
FIG. 4 is a schematic illustration of an isolation configuration according to the invention, according to a second embodiment.
Figure 5:
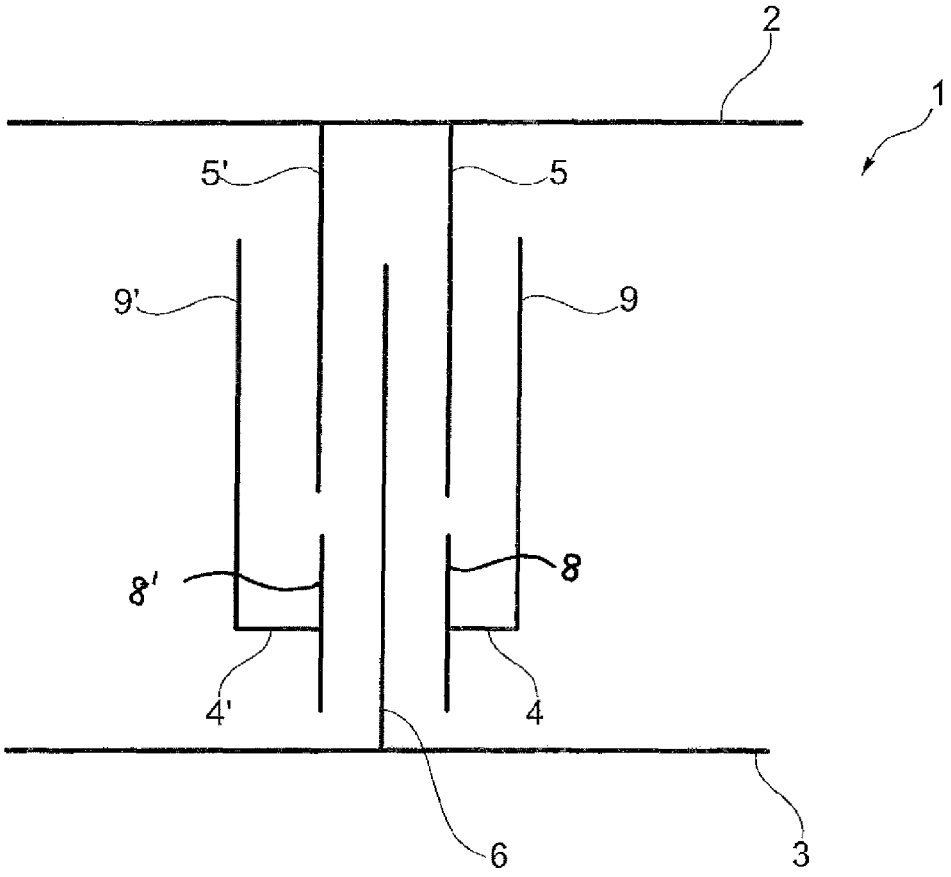
FIG. 5 is a schematic illustration of an isolation configuration of the invention, according to a third embodiment.
Figure 6:
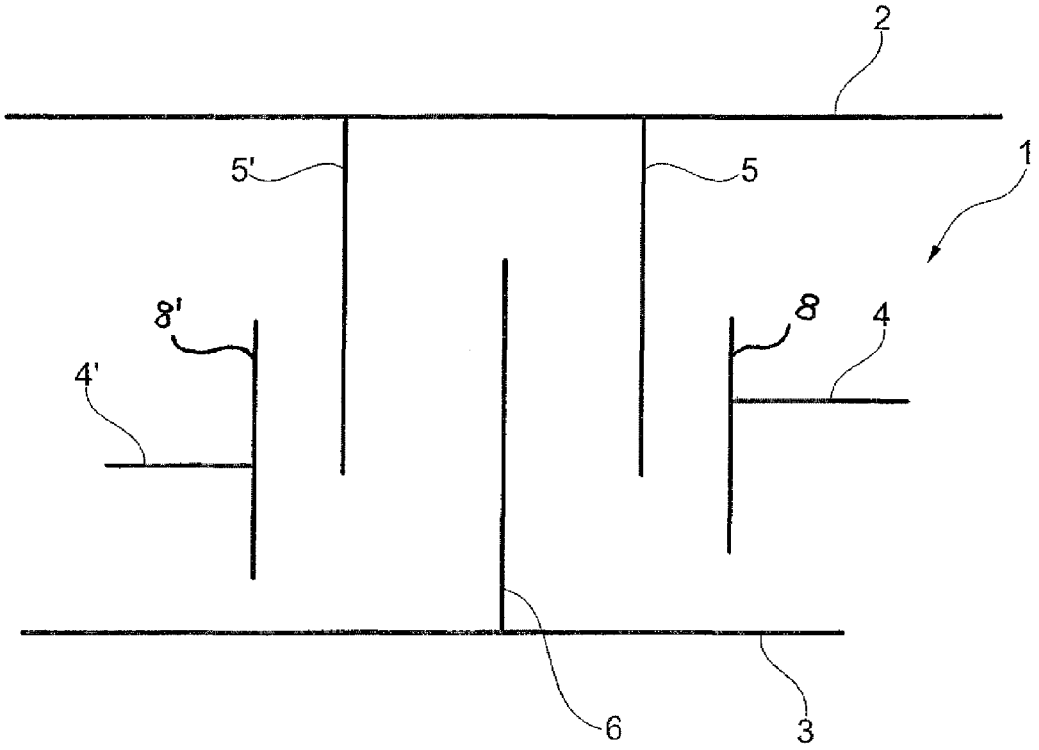
FIG. 6 is a schematic illustration of an isolation configuration of the invention, according to a fourth embodiment.

Just as FIG. 3 compared with FIG. 4 shows the kinematic reversal of the partition arrangement, this can be done also in FIGS. 5 and 6. FIGS. 5 and 6 therefore do not depict the kinematic reversal, which is intended however, to fall within the scope of the invention.

FIG. 3 shows a first embodiment according to the invention. Here, the cover 2 and the spring bracket 3 are disposed in parallel and spaced apart from one another.

In all of the embodiments of FIGS. 3 to 6 it is shown, however, that the fixed partitions provided on the cover and on the spring bracket form a larger overlap because the actuator is disposed outside this overlap region. The isolation properties of a relay of this type can be significantly improved in this manner.

FIG. 3 shows as an embodiment that a right contact row 11 is disposed on the right side of the isolation configuration and a left contact row 12 is disposed on the opposite side of the isolation configuration. The contacts of a contact row 11, 12 in this arrangement extend perpendicular to the drawing plane.

According to a first embodiment of the invention, it is provided in all of the embodiments that the partitions provided on the cover are integrally formed onto the underside of the cover and form one piece therewith in terms of material. According to a second embodiment of the invention, it is provided for all of the following embodiments that the partitions provided on the cover are not integrally formed directly onto the underside of the cover itself, but that these partitions are mounted on a separate support and that the underside of the cover is smooth and is snapped onto the relay.

The same embodiments as for the partitions provided on the cover also apply for the partitions provided on the spring bracket. Here, too, it is not essential to the invention that these form an integral part with the spring bracket in terms of material. Instead, they can be disposed on a separate support and can be implemented separately from the spring bracket.

The focus of the invention is therefore to improve the isolation capacity between the first contact row 11 and the second contact row 12 disposed opposite thereto.

As shown in the exemplary embodiment illustrated in FIG. 3, the cover 2 has two vertically extending partitions 5, 5' that extend toward the spring bracket 3. A single vertically extending partition 6 which extends between the two partitions 5, 5' of the cover 2 is disposed on the opposed spring bracket 3. The partition 6 thus dips down between the two partitions 5 and 5'.

With the present embodiment, the isolation is achieved exclusively by means of the fixed partitions 5 and 5' and the partition 6 dipping down between them.

The at least one movable actuator 4, 4' is disposed for the first time outside the isolation configuration created by the partitions 5, 5' and 6. The movable actuator 4, 4' preferably has at least one vertical flange 8, 8'. The at least one vertical flange 8, 8' adjoins at least one end of the actuator 4, 4' perpendicular to the length of the actuator, so as to form an extension of the actuator.

It is now novel in the present invention for the first time that the isolation configuration is formed exclusively by the partitions 5, 5' and the partition 6 dipping down between these partitions. The movable actuators 4, 4' having the flanges 8 and 8' are then disposed outside this isolation configuration.

FIG. 4 shows a further embodiment of the invention. The embodiment is a mirrored version of the embodiment according to FIG. 3.

From the cover 2, a vertical partition 5 now extends downward toward the spring bracket 3 extending parallel to the cover. The spring bracket 3 has two vertical partitions 6, 6' extending upward toward the cover. The partitions 6, 6' are disposed in such a way that they enclose the partition 5. The partition 5 thus dips down between the two partitions 6, 6'. This ensures the isolation between the rows of contacts.

In the configuration that is essential according to the invention, the movable actuators 4, 4' are disposed outside the isolation configuration created by the partitions 5, 6 and 6'.

In a further preferred embodiment, the movable actuator 4, 4' has a vertical flange 8, 8' that is integrally formed on the actuator and serves to improve the isolation.

FIG. 5 shows a further embodiment according to the invention. In this embodiment, the cover 2 has two vertically downwardly extending partitions 5, 5' extending toward the spring bracket 3 that is situated parallel to the cover. The spring bracket 3 has a single partition 6 extending vertically toward the cover and dipping down between the two partitions 5, 5'. The embodiment of FIG. 3 corresponds to the embodiment of FIG. 5, except that now at least one additional flange 9, 9' is integrally formed on the movable actuator 4, 4'.

FIG. 6 shows a further embodiment according to the invention. In the embodiment according to FIG. 6 it is novel that the actuator 4, 4' is disposed beside or at the level of the partitions 5, 5'.

In the embodiments according to FIGS. 3, 4 and 5, movable actuators 4, 4' are disposed at the level of the respective single partition 5 or 6. In the embodiment according to FIG. 6, each of the movable actuators 4, 4' is disposed at the level of the partition pairs 5, 5' or 6 and 6'.

It is essential to the invention that the isolation configuration is achieved exclusively by means of fixed partitions. The movable actuator generally does not serve to provide any isolation and is disposed outside the isolation configuration essential to the invention.

DRAWING LEGEND

1 Isolation configuration
2 Cover
3 Spring bracket
4 Actuator (4, 4')
5 Partition (5, 5')
6 Partition (6, 6')
7 Flange (7, 7')
8 Flange (8, 8')
9 Flange (9, 9')
10 Direction of arrow
11 Contact row
12 Contact row

What is claimed is:

1. A relay having a contact set, first and second members, one of said members being a cover and in the other of said members being a spring bracket separated from the cover by a space, at least one movable actuator is disposed in the space between the cover and the spring bracket, and an isolation configuration, wherein the contact set is disposed between the cover and the spring bracket and the contact set has rows of contacts, wherein said isolation configuration separates said rows of contacts and comprises:

two mutually parallel and mutually spaced apart fixed partitions provided on said first member and spaced from said second member; and at least one oppositely oriented fixed partition provided on said second member and spaced from said first member, and wherein, said isolation configuration is interposed between two of the rows of contacts, said at least one oppositely oriented fixed partition is interposed between said two mutually parallel and mutually spaced apart fixed partitions, and said partitions are disposed relative to one another to form an elongated electrical isolation path between said rows of contacts, said relay further comprising flanges having a length parallel to a plane in which said two mutually parallel and mutually spaced-apart partitions lie, wherein said flanges are integrally formed on the actuator and are disposed to retard burning of the contacts.

2. The relay having a contact set according to claim 1, wherein the actuator is disposed at the level of the at least one partition or of the at least one oppositely oriented fixed partition.

3. The relay having a contact set according to claim 1, wherein the at least one movable actuator is disposed outside the isolation configuration.

4. A relay having a contact set that is disposed between first and second members, one of the members being a cover and in the other of said members being a spring bracket, wherein the contact set is composed of first and second rows of contacts that are separated by an isolation configuration, said relay comprising:

at least one fixed partition provided on the first member;

at least one oppositely oriented fixed partition provided on the other member, and at least one movable actuator disposed in the space between the cover and the spring bracket, wherein the isolation configuration comprises:

said at least one fixed partition comprising two mutually parallel and mutually spaced-apart partitions each having a free edge that is spaced from the second member, said at least one oppositely oriented fixed partition consisting of one oppositely oriented partition having a free edge that is spaced from the first member and engaging between the partitions provided on the cover, and said partitions are disposed relative to one another to form an elongated electrical isolation path between said rows of contacts, said relay further comprising flanges having a length parallel to a plane in which said two mutually parallel and mutually spaced-apart partitions lie, wherein said flanges are integrally formed on the actuator.

5. The relay having a contact set according to claim 4, wherein the actuator is disposed at the level of the two partitions provided on the first member or at the level of the one partition provided on the other member.

6. The relay of claim 4, wherein said isolation configuration forms a labyrinth.

7. The relay of claim 4, wherein each said flanges has a portion that extends upwardly from the actuator and a portion that extends downwardly from the actuator.

* * * * *